US008678740B2

(12) United States Patent
Praisner et al.

(10) Patent No.: US 8,678,740 B2
(45) Date of Patent: Mar. 25, 2014

(54) TURBOMACHINE FLOW PATH HAVING CIRCUMFERENTIALLY VARYING OUTER PERIPHERY

(75) Inventors: Thomas J. Praisner, Colchester, CT (US); Eric A. Grover, Tolland, CT (US); Renee J. Jurek, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 470 days.

(21) Appl. No.: 13/022,209

(22) Filed: Feb. 7, 2011

(65) Prior Publication Data

US 2012/0201663 A1 Aug. 9, 2012

(51) Int. Cl.
*F01D 25/04* (2006.01)

(52) U.S. Cl.
USPC ..... 415/1; 415/119

(58) Field of Classification Search
USPC ..... 415/182.1, 220, 221, 232, 199.5, 119, 1
See application file for complete search history.

(56) References Cited

U.S. PATENT DOCUMENTS

| | | | | |
|---|---|---|---|---|
| 5,397,215 | A * | 3/1995 | Spear et al. | 415/191 |
| 5,513,952 | A * | 5/1996 | Mizuta et al. | 415/182.1 |
| 7,210,905 | B2 * | 5/2007 | Lapworth | 415/220 |
| 2005/0019152 | A1 * | 1/2005 | Seitz | 415/58.5 |
| 2010/0232954 | A1 * | 9/2010 | Clemen | 415/199.4 |
| 2010/0329852 | A1 * | 12/2010 | Brignole et al. | 415/159 |
| 2012/0003085 | A1 * | 1/2012 | Agneray et al. | 415/199.5 |

* cited by examiner

*Primary Examiner* — Edward Look
*Assistant Examiner* — William Grigos
(74) *Attorney, Agent, or Firm* — Carlson, Gaskey & Olds, P.C.

(57) ABSTRACT

A turbomachine includes an annular flow path section between a plurality of radially extending stator blades and a plurality of radially extending rotor blades. At least a portion of the flow path section has a circumferentially varying outer periphery.

18 Claims, 7 Drawing Sheets

FIG.6B

FIG.5
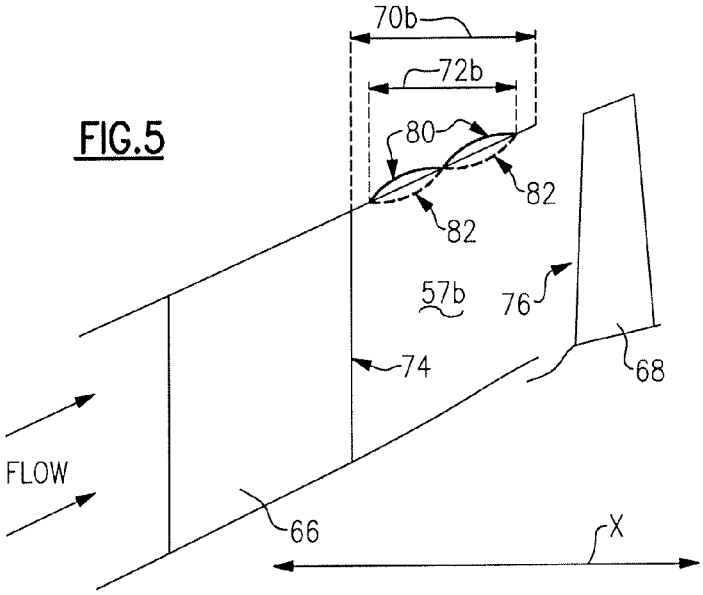
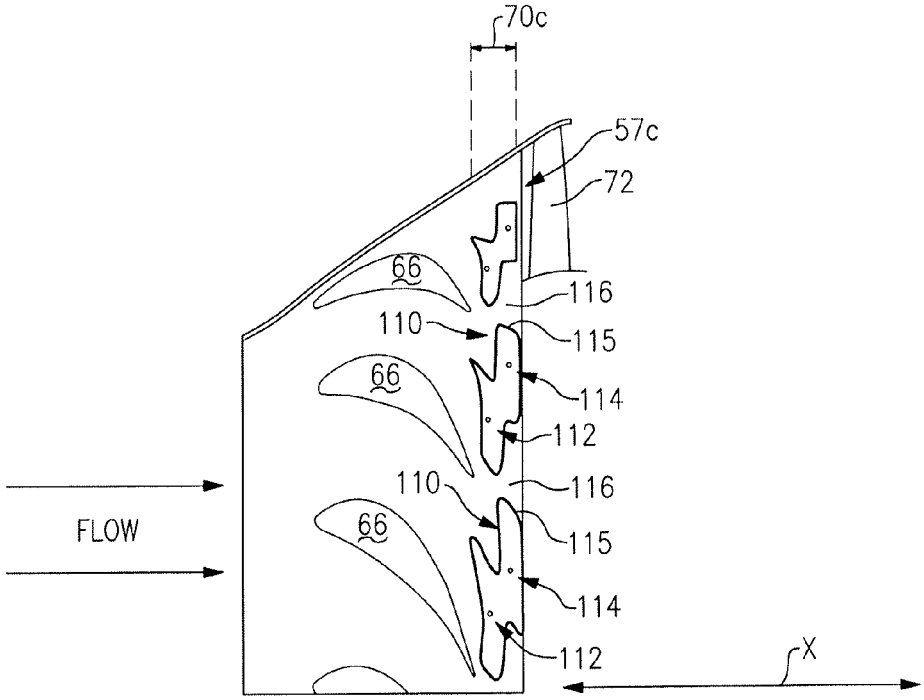
FIG.6A

TURBOMACHINE FLOW PATH HAVING CIRCUMFERENTIALLY VARYING OUTER PERIPHERY

BACKGROUND

This disclosure relates to turbomachines, and more particularly to an annular flow path of a turbomachine.

Turbomachines include flow paths with a plurality of airfoils, both non-rotating stator vanes and rotating rotor blades, typically arranged in an axially alternating configuration. Such flow paths are defined between radially-inward and radially-outward endwalls, or periphery, that guide air flow within the turbomachine. The interaction between the air flow progressing through such a flow path and the plurality of airfoils may result in the formation of a non-uniform pressure field within the flow path. Rotor blade airfoils that are moving through this non-uniform pressure field may experience the non-uniform pressure field in a time-varying manner which may result in the generation of time-varying stresses within the airfoil. The magnitude of these stresses may be of considerable concern if they compromise the structural integrity of the rotor blades due to material failure.

SUMMARY

A turbomachine according to one non-limiting embodiment includes an annular flow path section between a plurality of radially extending stator vanes and a plurality of radially extending rotor blades. At least a portion of the flow path section has a circumferentially varying outer periphery.

A method of reducing vibratory stresses on a plurality of radially extending rotor blades according to one non-limiting embodiment defines an annular flow path section between a plurality of radially extending stator vanes and a plurality of radially extending rotor blades. A portion of said flow path section is defined to have a circumferentially varying outer periphery.

These and other features of the present invention can be best understood from the included specification and drawings, the following of which is a brief description.

BRIEF DESCRIPTION OF THE DRAWINGS

FIG. 5 schematically illustrates an example flow path having a circumferentially varying outer periphery, and having more than a single peak or trough axially along the centerline axis of the turbomachine.

FIG. 6*a* illustrates a topological view of another example flow path having a circumferentially varying outer periphery, and having more than a single peak or trough axially along the centerline axis of the turbomachine.

DETAILED DESCRIPTION

Figure 1:
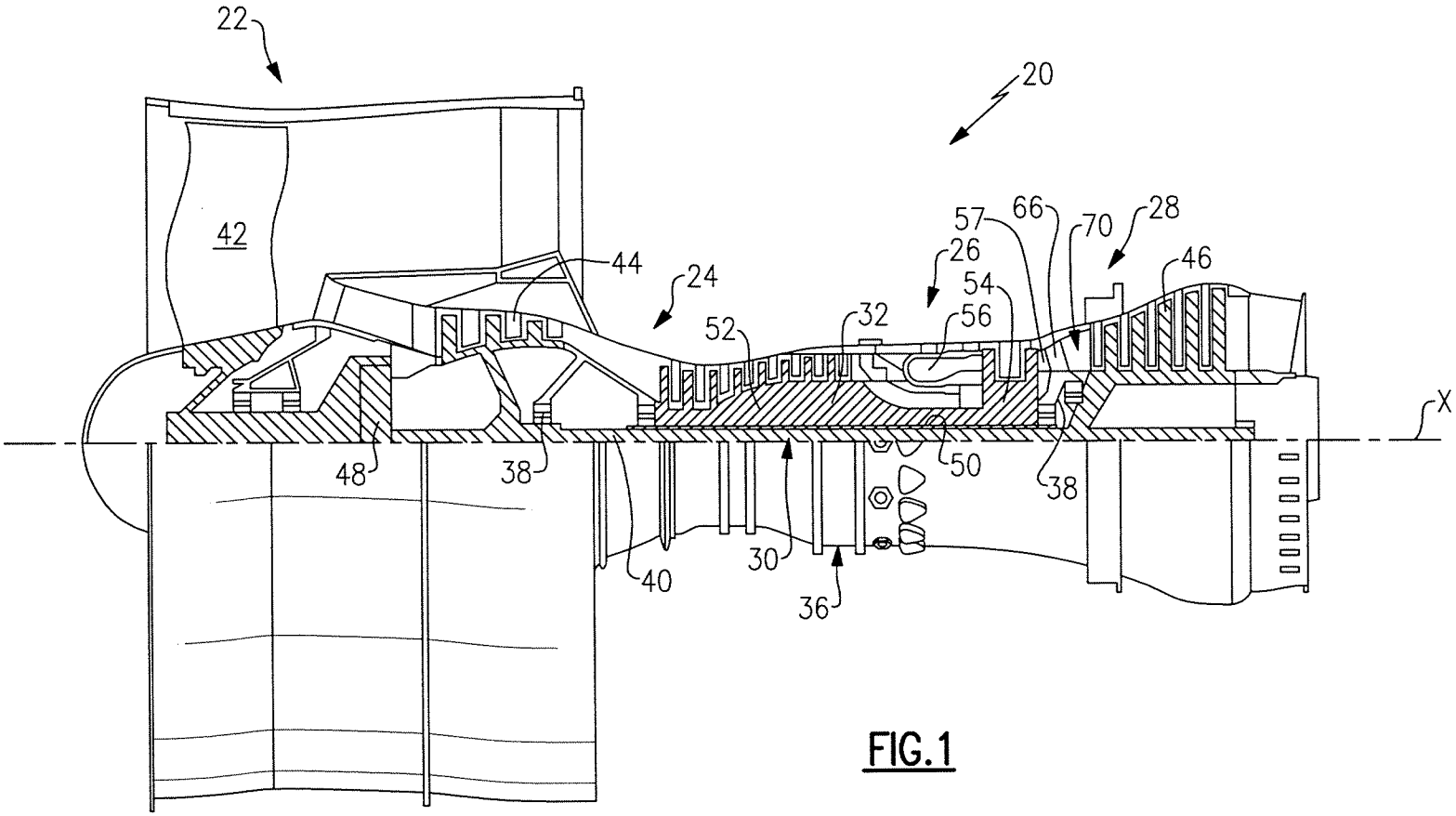
FIG. 1 is a schematic cross-section of a gas turbine engine having an annular flow path.

With reference to FIG. 1, a gas turbine engine 20 is disclosed as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path, while the compressor section 24 drives air along a core flow path for compression and communication into the combustor section 26. Although the turbomachine disclosed herein is a turbofan gas turbine engine 20, and it is understood that other flow paths and other turbomachines could be used (e.g., land-based turbines, compressors, etc.).

The engine 20 generally includes a low speed spool 30 and a high speed spool 32 mounted for rotation about a centerline axis X of the gas turbine engine 20 relative to an engine static structure 36 via several bearing systems 38. The low speed spool 30 generally includes an inner shaft 40 that interconnects a fan 42, a low pressure compressor 44 and a low pressure turbine 46. The inner shaft 40 may drive the fan 42 either directly or through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the centerline axis X, which is collinear with their longitudinal axes.

Core airflow is compressed by the low pressure compressor 44 then the high pressure compressor 52, mixed with the fuel in the combustor 56, then expanded over the high pressure turbine 54 and low pressure turbine 46 along annular flow path 57. The turbines 54, 46 rotationally drive the respective low speed spool 30 and high speed spool 32 in response to the expansion.

Figure 2:
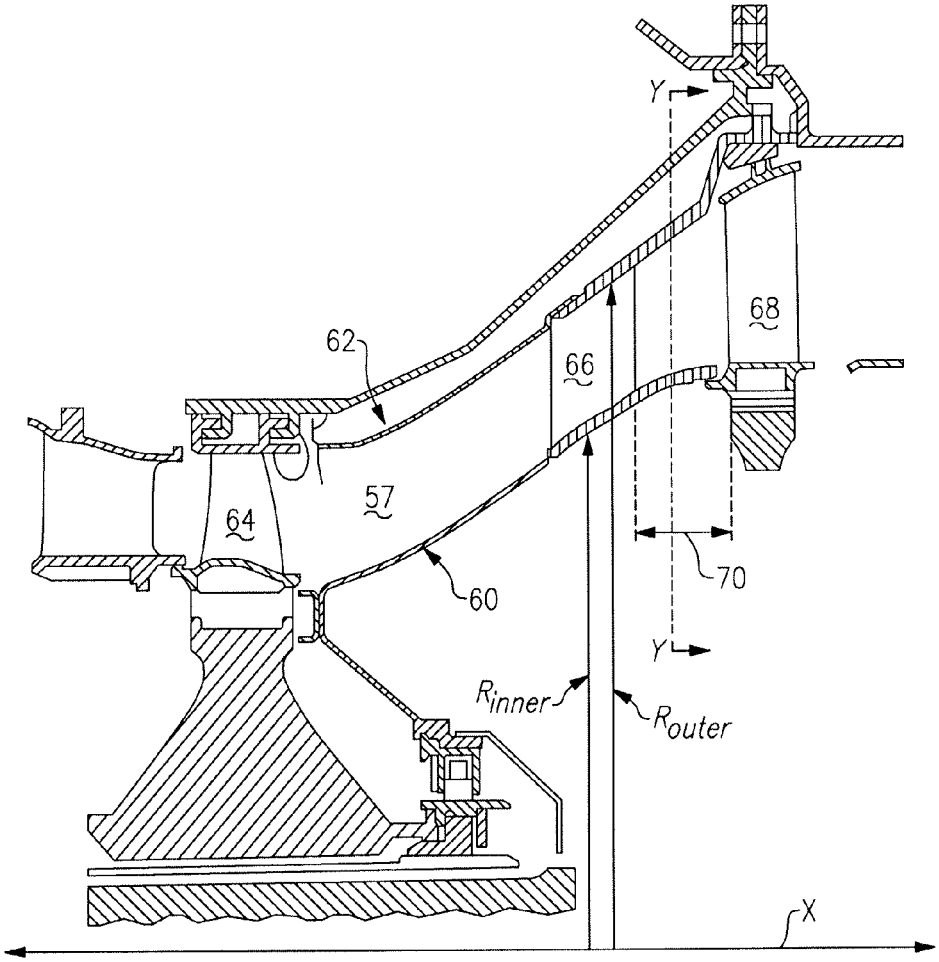
FIG. 2 is an enlarged schematic cross section of the gas turbine engine of FIG. 1.

With reference to FIG. 2, an inner wall 60 and an outer wall 62 at least partially define the annular flow path 57. The flow path 57 extends across a transition duct region of the engine 20, from rotor blades 64 (corresponding to high pressure turbine 54) through passages formed by a plurality of stator vanes 66 to rotor blades 68 (corresponding to low pressure turbine 46). The rotor blades 68 rotate about the centerline axis X. Although only one stator vane 66 is shown, it is understood that the stator vane 66 is one of a plurality of radially extending stator vanes. Also, although only one rotor blade 68 is shown, it is understood that the rotor blade 68 is one of a plurality of radially extending rotor blades that rotates about the axis X. The annular flow path 57 has an outer radius $R_{outer}$ and an inner radius $R_{inner}$ with respect to the axis X. As will be described below with reference to FIGS. 3-9, at least a portion of a platform wing section 70 of the annular flow path 57 has a circumferentially varying outer periphery.

Figure 3:
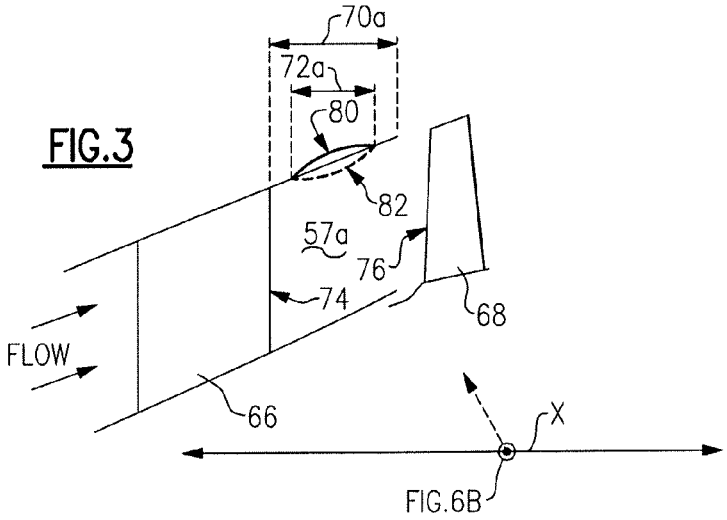
FIG. 3 schematically illustrates an example flow path having a circumferentially varying outer periphery, and having a single peak or trough axially along a centerline axis of the turbomachine.

With reference to FIG. 3, in one non-limiting embodiment a platform wing section 70*a* of annular flow path 57*a* extends between a trailing edge 74 of stator vanes 66 and a leading edge 76 of rotor blades 68. A portion 72*a* of the platform wing section 70*a* has a circumferentially varying outer periphery featuring a series of alternating peaks 80 and troughs 82 circumferentially around the portion 72*a*. In the non-limiting embodiment of FIG. 3, the circumferentially varying outer periphery of portion 72*a* includes one peak 80 or trough 82 axially along the axis X.

Figure 4:
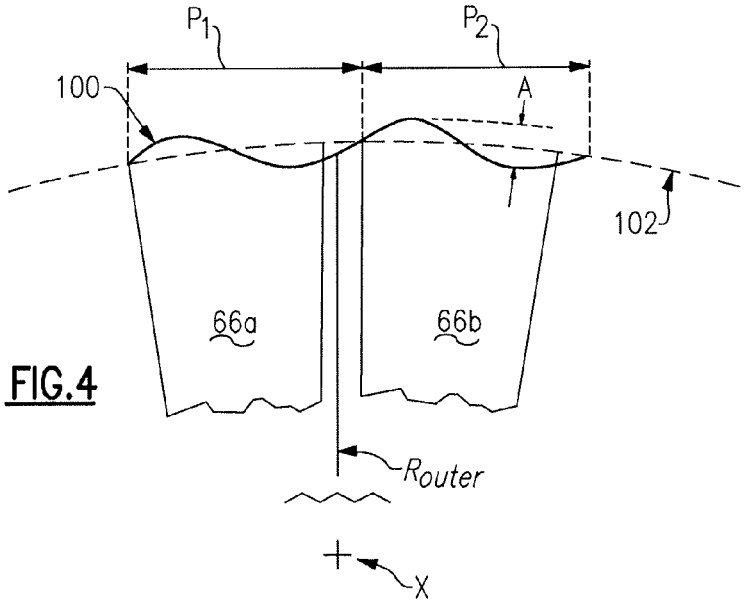
FIGS. 4 and 4*a* schematically illustrate perspective views of the flow path of FIG. 3 along line Y-Y of FIG. 2.
Figure 4A:
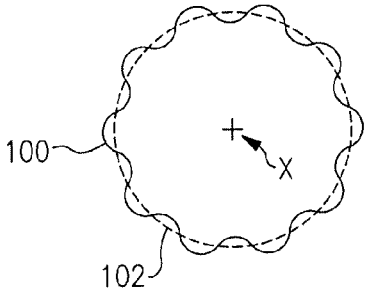

With reference to FIGS. 4 and 4*a* (which illustrate perspective views of the flow path 57*a* along line Y-Y of FIG. 2), in one non-limiting embodiment the outer periphery of the portion 72*a* may be defined by a circumferentially repeating pattern 100 which is non-axisymmetric with respect to turbomachine axis X, unlike conventional outer periphery 102 that is axisymmetric with respect to the axis X.

In the non-limiting embodiment of FIG. 4, the pattern 100 is defined to repeat once with each circumferential vane pitch $P_1$, $P_2$, etc. of vanes 66*a*, 66*b*. If the vanes 66*a*, 66*b* are constructed separately and are later assembled to abut each other, the pattern 100 that repeats with each vane pitch $P_1$, $P_2$, etc. avoids abrupt changes in the outer periphery of the flow path 57*a*. Of course, this is only an example pattern, and it is understood that other patterns would be possible. For example, the pattern 100 may instead repeat with multiples of vanes (e.g., repeat every 2 vanes, repeat every 3 vanes, etc.).

With reference to FIG. 5, in one non-limiting embodiment a portion 72*b* of platform wing section 70*b* of annular flow path 57*b* having a circumferentially varying outer periphery may include a multiple of axially offset peaks 80, a multiple of axially offset troughs 82, or an axially offset peak 80 and trough 82 along axis X. In one example the outer periphery may be defined to have raised peak sets that are axially and circumferentially offset from each other.

Referring to FIG. 6*a*, in one non-limiting embodiment, a topological view is shown of an exterior of a platform wing section 70*c* of annular flow path 57*c* having a circumferentially varying outer periphery featuring a plurality of raised peak sets 110. Each set 110 of raised peaks includes two peaks 112, 114 that are axially offset from each other and are circumferentially offset and out of phase with each other. The raised peak sets 110 are part of topologically raised areas, shown by outer boundary 115. An area 116 between the sets 110 of peaks 112, 114 may include lowered areas having lowered peaks (see, e.g., FIG. 5).

Figure 6B:
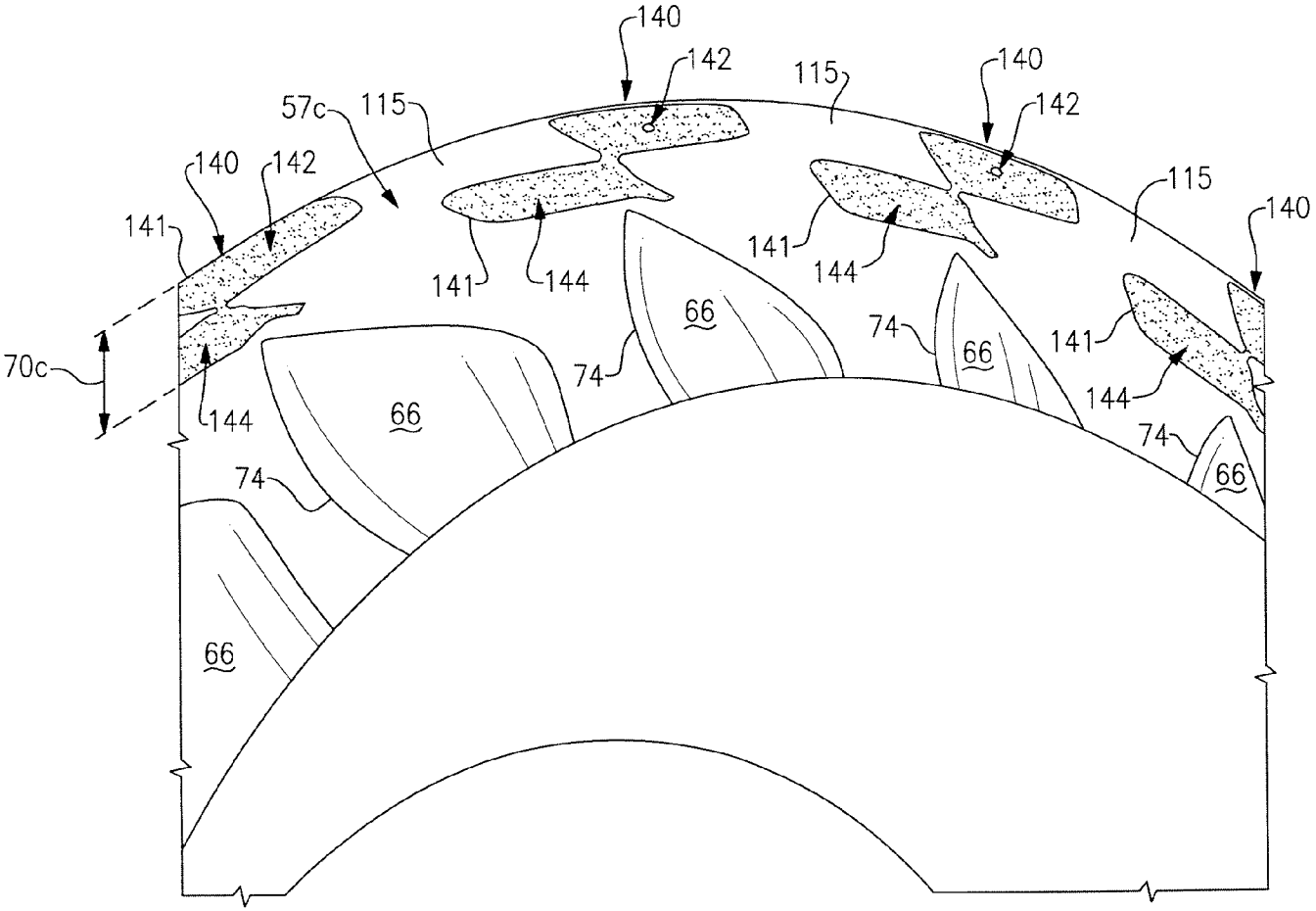
FIG. 6*b* illustrates a topological view of an interior of the example flow path of FIG. 6*a* from a vantage point shown on the turbomachine centerline axis of FIG. 3 aft of a turbomachine stator vane looking upstream.

FIG. 6*b* shows another non-limiting embodiment of a topological view of an interior of the flow path 57*c* from the perspective shown in FIG. 3 on the turbomachine centerline axis X aft of the stator vane 66, looking upstream. As shown, a plurality of lowered peak sets 140 is located between the topologically raised areas 115 of FIG. 6*a*. The lowered peak sets 140 are part of topologically lowered areas 141, and each include two peaks 142, 144 that are circumferentially offset and out of phase with each other. In one example the topologically lowered areas correspond to the area 116 of FIG. 6*a*.

Figure 7:
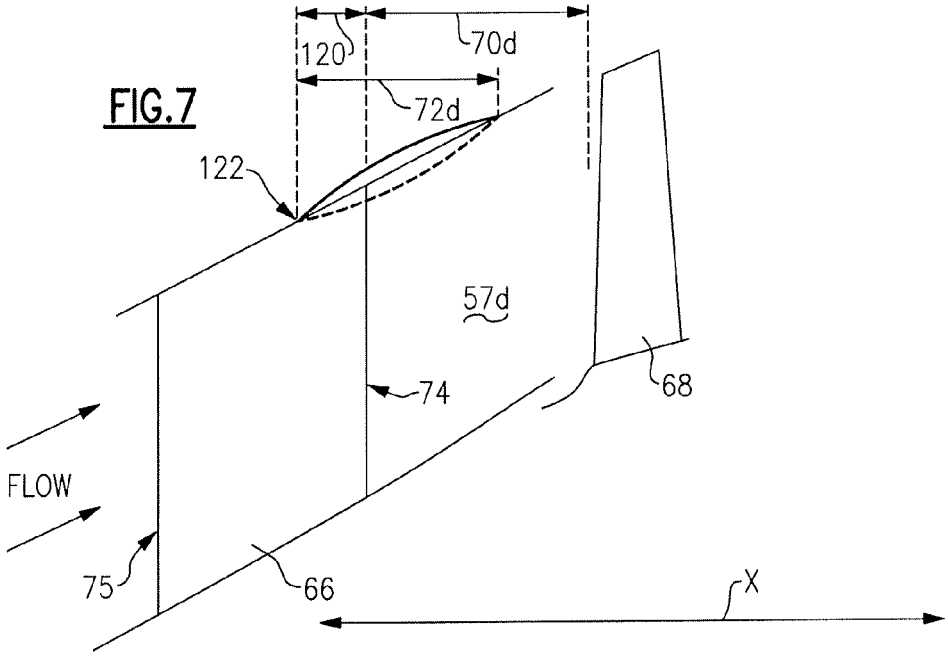
FIG. 7 schematically illustrates an example flow path having a circumferentially varying outer periphery that extends axially upstream of the trailing-edge of a stator vane.

With reference to FIG. 7, in one non-limiting embodiment, a flow path section 72*d* of annular flow path 57*d* having a circumferentially varying outer periphery may extend beyond the trailing edge 74 of the stator vane 66 to include a flow path portion 120 that terminates at a location 122 fore of the trailing edge 74. In the non-limiting embodiment of FIG. 7, the location 122 is located at an intermediate location between the trailing edge 74 and leading edge 75 of the stator vane 66.

Figure 8:
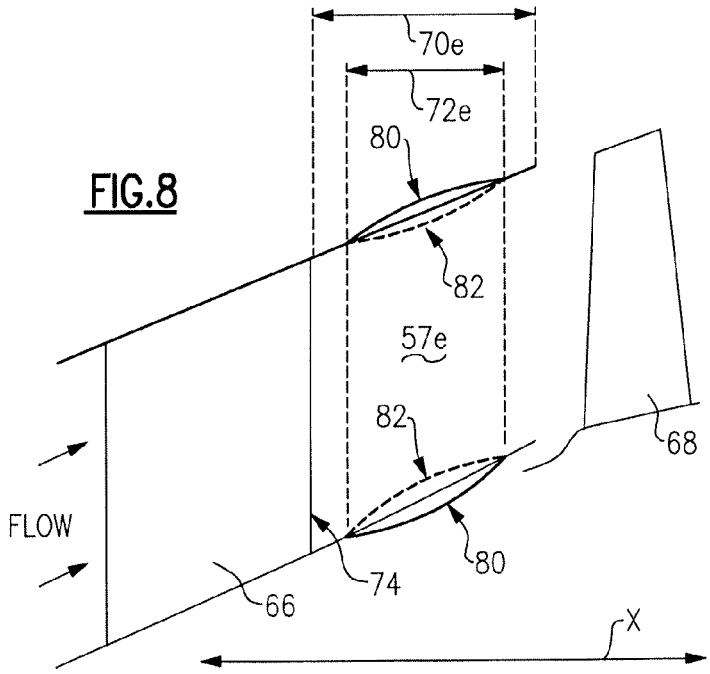
FIG. 8 schematically illustrates an example flow path portion having a circumferentially varying outer periphery and a circumferentially varying inner periphery.

With reference to FIG. 8, in one non-limiting embodiment, a flow path portion 72*e* of platform wing section 70*e* of annular flow path 57*e* may include a circumferentially varying outer periphery and a circumferentially varying inner periphery, such that both the inner and outer periphery of the flow path portion 72*e* vary circumferentially about the annular flow path 57*e*. Although the inner periphery of flow path portion 72*e* is shown as only including a single peak 80 or trough 82 axially along axis X, it is understood that the inner periphery could include multiple peaks or troughs such as the outer periphery of portion 72*b* of FIG. 5.

Figure 9:
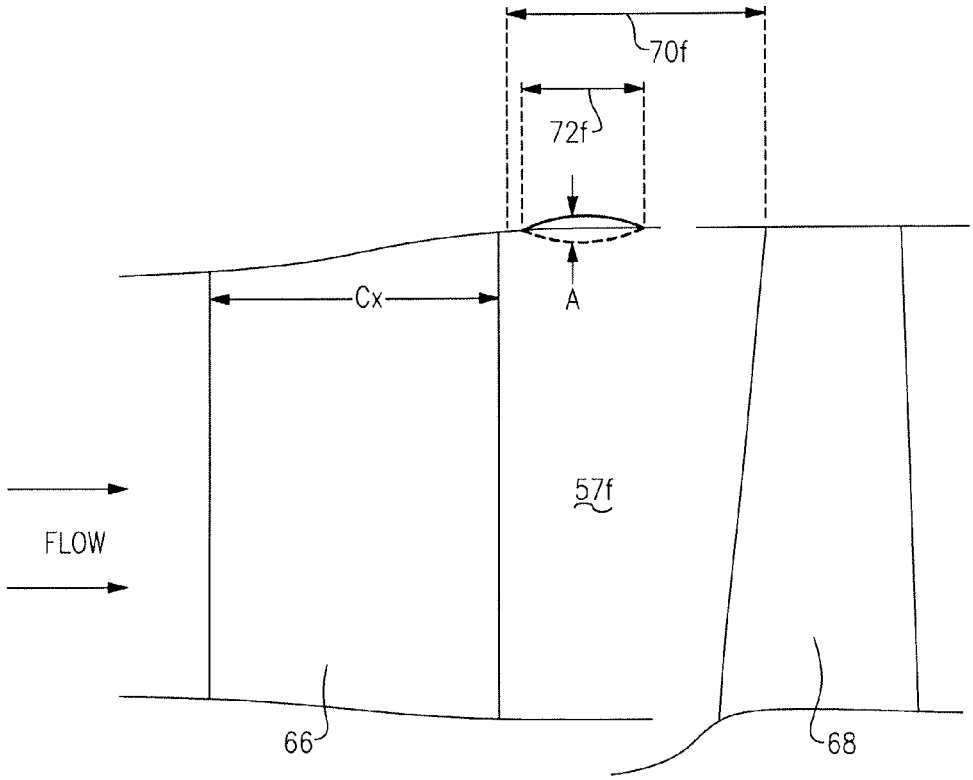
FIG. 9 schematically illustrates a ratio of an outer periphery peak-to-trough amplitude to a stator vane axial chord length.

With reference to FIG. 9, the magnitude of the annular flow path outer periphery circumferential variations may be quantified in relation to stator vane axial chord length. As shown in FIG. 9, portion 72*f* of annular flow path 57*f* has a peak to trough amplitude of A. In the non-limiting embodiment of FIG. 9, a ratio of A to an axial chord length G of the stator vane 66 is greater than or equal to 0.005. Of course, this is only an example, and other ratios would be possible. In one example this same ratio applies to the circumferentially varying inner periphery (FIG. 8).

The circumferentially varying outer periphery (and the optional circumferentially varying inner periphery) of the flow path portion 72 reduces vibratory stresses on the rotor blades 68 while the rotor blades 68 are rotating. In one example the circumferentially varying periphery can achieve a vibratory stress reduction on the order of 10-20% for the rotor blades 68. Computer simulations may optionally be performed to optimize the flow path 72 in order to determine optimal flow path dimensions.

Although embodiments of this disclosure has been illustrated and disclosed, a worker of ordinary skill in this art would recognize that certain modifications would come within the scope of this invention. For that reason, the following claims should be studied to determine the true scope and content of this invention.

What is claimed is:

1. A turbomachine, comprising:

an annular flow path section between a plurality of radially extending stator vanes and a plurality of radially extending rotor blades, at least a first portion of the flow path section having a circumferentially varying outer periphery, wherein the annular flow path section corresponds to a platform wing of the turbomachine and extends between a trailing edge of the stator vanes and a leading edge of the rotor blades.

2. The turbomachine as recited in claim 1, wherein the circumferentially varying outer periphery of the first portion includes a series of alternating peaks and troughs circumferentially around the first portion.

3. The turbomachine as recited in claim 1, wherein the outer periphery of the first portion is non-axisymmetric with respect to a centerline turbomachine axis.

4. The turbomachine as recited in claim 1, wherein the circumferentially varying outer periphery is defined by a circumferentially repeating pattern along the outer periphery, the pattern repeating at least once with each circumferential vane pitch.

5. A turbomachine, comprising:

an annular flow path section between a plurality of radially extending stator vanes and a plurality of radially extending rotor blades, at least a first portion of the flow path section having a circumferentially varying outer periphery, wherein the outer periphery of the first portion defines a plurality raised peak sets, each raised peak set including two peaks that are axially and circumferentially offset from each other.

6. The turbomachine as recited in claim 1, wherein the outer periphery of the first portion is optimized to reduce vibratory stresses on the plurality of radially extending rotor blades.

7. The turbomachine as recited in claim 1, wherein the radially extending stator vanes are airfoil vanes of a gas turbine engine, and the radially extending rotor blades are rotor blades of the gas turbine engine.

8. The turbomachine as recited in claim 7, wherein the radially extending rotor blades correspond to a low pressure turbine of the gas turbine engine, and wherein the annular flow path extends from a high pressure turbine fore of the stator vanes around the plurality of stator vanes to the low pressure turbine.

9. The turbomachine as recited in claim 1, wherein a ratio of a peak to trough amplitude of the outer periphery of the first portion to an axial chord length of one of the plurality of radially extending stator vanes is greater than or equal to 0.005.

10. A turbomachine, comprising:

an annular flow path section between a plurality of radially extending stator vanes and a plurality of radially extending rotor blades, at least a first portion of the flow path section having a circumferentially varying outer periphery, wherein the first portion of the flow path section also has a circumferentially varying inner periphery.

11. The turbomachine as recited in claim 10, wherein a ratio of a peak to trough amplitude of the inner periphery of the first portion to an axial chord length of one of the plurality of radially extending stator vanes is greater than or equal to 0.005.

12. A turbomachine, comprising:

an annular flow path section between a plurality of radially extending stator vanes and a plurality of radially extending rotor blades, at least a first portion of the flow path section having a circumferentially varying outer periphery, wherein a second portion of the flow path extends from the first portion beyond a trailing edge of the plurality of stator vanes to a location intermediate the trailing edge and a leading edge of the plurality of stator vanes, the second portion also having a circumferentially varying outer periphery, the circumferentially varying outer periphery of the first portion being continuous with the circumferentially varying outer periphery of the second portion.

13. A method of reducing vibratory stress on a plurality of radially extending rotor blades, comprising:

defining an annular flow path section between a plurality of radially extending stator vanes and a plurality of radially extending rotor blades;

defining a first portion of the flow path section to have a circumferentially varying outer periphery; and defining the first portion of the flow path section to have a circumferentially varying inner periphery.

14. The method of claim 13, wherein the first portion of the annular flow path is defined such that a ratio of a peak to trough amplitude of the outer periphery of the first portion to an axial chord length of one of the plurality of radially extending stator vanes is greater than or equal to 0.005.

15. The method of claim 13, wherein the circumferentially varying outer periphery of the first portion is defined by a circumferentially repeating pattern along the outer periphery, the pattern repeating at least once with each circumferential vane pitch.

16. The method of claim 13, wherein the outer periphery of the first portion is non-axisymmetric with respect to a centerline turbomachine axis.

17. The method of claim 13, wherein the circumferentially varying outer periphery of the first portion is defined to include a series of alternating peaks and troughs circumferentially around the first portion.

18. The method of claim 13, wherein the first portion of the flow path is defined such that the outer periphery of the first portion forms a plurality raised peak sets, each raised peak set including two peaks that are axially and circumferentially offset from each other.

* * * * *